US011359436B2

(12) United States Patent
De Frene et al.

(10) Patent No.: US 11,359,436 B2
(45) Date of Patent: Jun. 14, 2022

(54) SCREEN DEVICE

(71) Applicant: RENSON SUNPROTECTION-SCREENS NV, Waregem (BE)

(72) Inventors: Joost Benjamin Renaat De Frene, Waregem (BE); Steven Rita André Vanhoutte, Deerlijk (BE)

(73) Assignee: RENSON SUNPROTECTION-SCREENS NV

( * ) Notice: Subject to any disclaimer, the term of this patent is extended or adjusted under 35 U.S.C. 154(b) by 255 days.

(21) Appl. No.: 16/300,215

(22) PCT Filed: May 8, 2017

(86) PCT No.: PCT/IB2017/052656
§ 371 (c)(1),
(2) Date: Nov. 9, 2018

(87) PCT Pub. No.: WO2017/195087
PCT Pub. Date: Nov. 16, 2017

(65) Prior Publication Data

US 2019/0153778 A1 May 23, 2019

(30) Foreign Application Priority Data

May 9, 2016 (BE) ..... 2016/5329

(51) Int. Cl.
*E06B 9/72* (2006.01)
*E06B 9/13* (2006.01)
(Continued)

(52) U.S. Cl.
CPC ..... *E06B 9/72* (2013.01); *E06B 9/13* (2013.01); *E06B 9/171* (2013.01); *E06B 9/42* (2013.01); *E06B 9/581* (2013.01)

(58) Field of Classification Search
CPC ..... E06B 9/72; E06B 2009/725; E06B 9/44; E06B 9/13; E06B 9/171; E06B 9/581;
(Continued)

(56) References Cited

U.S. PATENT DOCUMENTS 1,800,654 A * 4/1931 Nelson ..... E06B 9/44 160/262
5,123,474 A * 6/1992 Smith ..... E06B 9/13 160/273.1
(Continued)

FOREIGN PATENT DOCUMENTS

EP 91278 A1 * 10/1983
EP 0272733 A1 6/1988
(Continued)

OTHER PUBLICATIONS

International Search Report and Written Opinion dated Aug. 17, 2017.

*Primary Examiner* — Johnnie A. Shablack
*Assistant Examiner* — Jeremy C Ramsey
(74) *Attorney, Agent, or Firm* — Fresh IP PLC; Clifford D. Hyra; Aubrey Y. Chen

(57) ABSTRACT

A screen device comprising: a screen roller (1), having a screen (2), which can be rolled up and unrolled hereon and which on at least one lateral side is provided with a thickening (6), a motor (7) for driving the screen roller (1), which motor, at that end of the screen roller (1) closest to the thickening (6), is disposed at least partially in the screen roller (1), wherein the motor (7) is fitted so far into the screen roller (1) that the thickening (6), in the rolled-up state of the screen (2), is positioned at least partially closer to the screen roller axis (A) than any point on that part of the motor (7) that is fitted in the screen roller (1), which point is situated the furthest from this screen roller axis (A).

14 Claims, 1 Drawing Sheet

(51) Int. Cl.
*E06B 9/171* (2006.01)
*E06B 9/58* (2006.01)
*E06B 9/42* (2006.01)

(58) Field of Classification Search
CPC ... E06B 9/08; E06B 9/17; E06B 9/322; E06B 9/34; E06B 9/368; E06B 9/40; E06B 9/54; E06B 9/56; E06B 9/42; E06B 2009/1716; E06B 9/68
See application file for complete search history.

(56) References Cited

U.S. PATENT DOCUMENTS

2012/0018105 A1* 1/2012 Lin ..... E06B 9/40 160/238
2012/0255688 A1* 10/2012 Hintennach ..... E06B 9/44 160/313
2015/0308187 A1* 10/2015 Lu ..... E06B 9/42 160/319
2017/0211315 A1* 7/2017 Fleischman ..... E06B 9/17007
2018/0216403 A1* 8/2018 Gomaa ..... E06B 9/581
2018/0259033 A1* 9/2018 Basutto ..... E06B 9/322
2018/0283096 A1* 10/2018 Nelson ..... E06B 9/44
2019/0153778 A1* 5/2019 De Frene ..... E06B 9/42

FOREIGN PATENT DOCUMENTS

EP 1491712 A2 12/2004
EP 1669537 A2 6/2006
EP 2182161 B1 6/2014
FR 2602539 A1 2/1988
FR 2886332 * 2/2006
NL 1014061 C2 7/2001
NL 1 029 104 C2 11/2006
NL 1029104 C2 11/2006

* cited by examiner

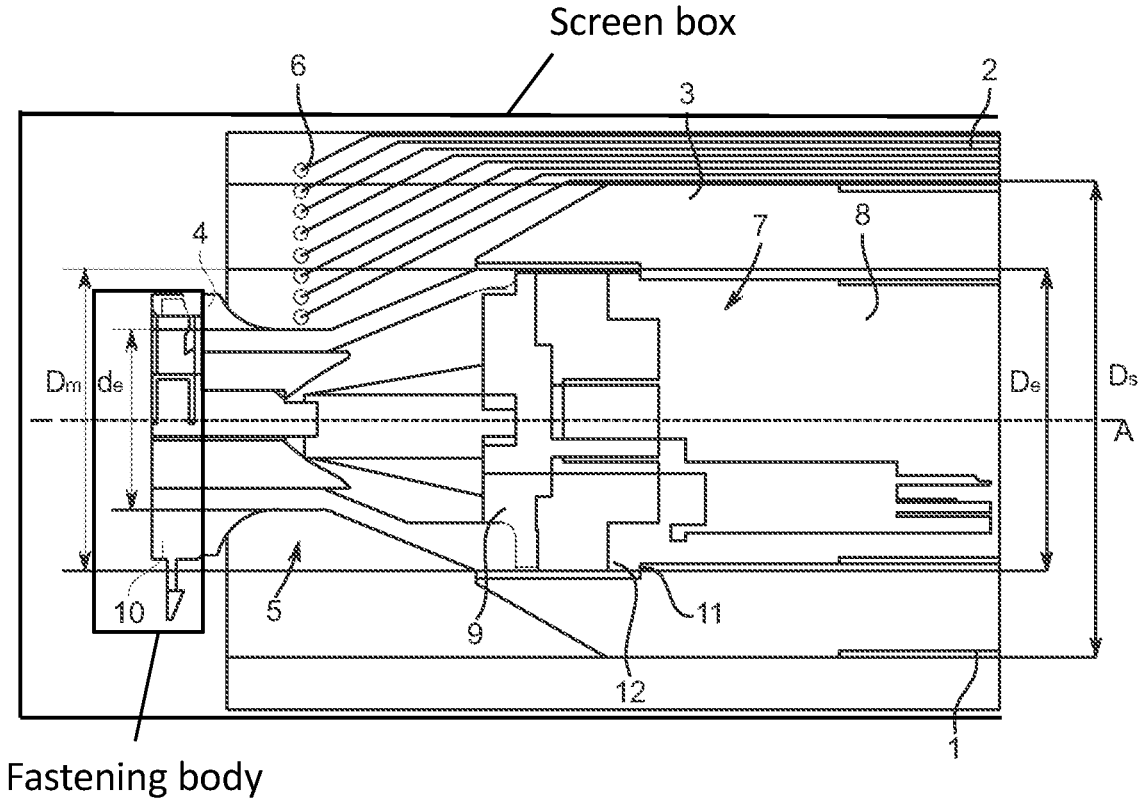
Screen box
6
3
2
4
7
8
Dm
de
De
Ds
A
10
5
9
11
12
1
Fastening body

SCREEN DEVICE

This application claims the benefit of Belgian patent application No. BE2016/5329, filed May 9, 2016, which is hereby incorporated by reference in its entirety.

FIELD OF THE DISCLOSURE

This invention relates to a screen device comprising:

a screen roller, which is arranged rotatably about a screen roller axis;

a screen, which can be rolled up and unrolled on this screen roller and which on at least one lateral side is provided with a thickening, which latter, in the rolled-up state of the screen, is positioned at least partially closer to the screen roller axis than any point on the outer circumference of the screen roller that is furthest from this screen roller axis;

and a motor for driving the screen roller, which motor, at that end of the screen roller that is positioned the closest to the thickening, is disposed at least partially in the screen roller.

BACKGROUND

Screen devices having a screen which can be rolled up on a screen roller and which is provided with thickenings on the lateral sides are already repeatedly described in patent literature, such as, inter alia, in FR 2 602 539 A1, NL 1 029 104 C, EP 1 669 537 A2, NL 1 014 061 C, EP 1 491 712 A2 and EP 0 272 733 A1. During the roll-up and unrolling movement of the screen, such thickenings are guided in screen guides. These thickenings are often designed in the form of half zip fasteners, by providing the screen with half zip fasteners on the lateral sides.

In order to secure such a screen well in these guides, so that its sides cannot readily come loose under sudden gusts of wind and so that flapping of the screen is as far as possible avoided, these thickenings must be made sufficiently thick. As stated in EP 0 272 733 A1 and NL 1 029 104 C, a problem with providing such relatively thick thickenings on the lateral sides of the screen is that, when the screen is rolled up, adjacent to these thickenings there are also obtained relatively thick regions, for which space has to be provided.

In EP 0 272 733 A1, the lateral sides of the screen, which are provided with the thickenings, hence extend beyond the ends of the screen roller in order to avoid an accumulation of the thickenings of the screen on the screen roller.

In NL 1 029 104 C and EP 2 182 161 B1, constrictions are provided at the ends of the screen roller in order to create space for these thickenings and to avoid creasing of the screen and folding over of the thickenings during rolling up onto the screen roller.

In such motorized screen devices, there remains a further problem, however, in the form of the skewing of the bottom lath, fastened to the roll-up and unrollable screen, at the end away from the screen roller, this when the ends of the screen do not roll up evenly.

If the screens are made longer, the problem of creasing of the screen and folding over of the thickenings also recurs.

SUMMARY

An object of this invention is to be able to remedy these problems.

This object of the invention may be achieved by providing a screen device comprising:

a screen roller, which is arranged rotatably about a screen roller axis;

a screen, which can be rolled up and unrolled on this screen roller and which on at least one lateral side is provided with a thickening, which latter, in the rolled-up state of the screen, is positioned at least partially closer to the screen roller axis than any point on the outer circumference of the screen roller that is furthest from this screen roller axis;

and a motor for driving the screen roller, which motor, at the said end, is disposed at least partially in the screen roller;

wherein the motor is fitted so far into the screen roller that the thickening, in the rolled-up state of the screen, is positioned at least partially closer to the screen roller axis than any point on that part of the motor that is fitted in the screen roller, which point is situated the furthest from this screen roller.

In the prior art of motorized screen devices having the said thickenings on the lateral sides of the screen, the position which this thickening could assume in the rolled-up state was partly limited by the dimensions of the motor. By, according to an embodiment of the invention, displacing the motor of a such a screen device, it can be ensured that this limitation ceases to exist and that the thickening can now come closer to the screen roller axis than the furthest points on that part of the motor that is fitted in the screen roller axis. Since the thickening can be brought closer up to the screen roller axis, the problem of skewing of the bottom lath can be remedied and, even in the case of longer screens, it can be ensured that the thickenings do not start to topple over or that creasing of the screen can be avoided.

By virtue of this new placement of the motor, the diameter of the screen roller can also be limited in screen devices where the said problems no longer occurred. With a more compact screen roller, a possible screen box in which this screen roller is disposed can also be made more compact.

Preferably, a screen device according to an embodiment of this invention also comprises at least one screen guide for guiding a corresponding thickening during the roll-up and unrolling movement of the screen.

In a preferential screen device according to an embodiment of this invention, the motor is an electronic tube motor. With such a tube motor, end positions for the roll-up and unrolling of the screen can namely also be set without the tube motor itself having to be accessible for this purpose. In this way, it is easier to fit the tube motor deeper in the screen roller than in the prior art.

A specific embodiment of a screen device according to this invention comprises at the said end a screen roller end piece, which is provided with a constriction such that, when the screen is rolled up and unrolled, the flexible thickening ends up adjacent to this constriction.

The screen roller end piece can in this case, viewed in the longitudinal direction of the screen roller, connect directly to the screen roller, possibly be disposed partially in the screen roller, or can also be disposed at a distance apart from the screen roller.

In view of the fact that the thickening is positioned at least partially closer to the screen roller axis, in this specific embodiment the constriction of such a screen roller end piece according to an embodiment of the invention for a same screen roller is made stronger than in the existing such screen devices, wherein the motor extends always with a very wide piece into the screen roller end piece adjacent to the constriction.

Preferably, the largest external dimension of the screen roller end piece closest to the screen roller, viewed transversely to the longitudinal direction of the screen roller, in a plane through the screen roller axis, is smaller than the outside diameter of the screen roller.

The screen roller end piece preferably further comprises a smooth shell surface.

In addition, the screen roller end piece is preferably designed such that it tapers, on the side of the screen roller, towards the constriction.

The screen roller end piece can be fixedly fastened to the screen roller, this possibly with the aid of an intermediate piece.

In a particularly preferential embodiment of a screen device according to this invention, the screen roller end piece, however, in the mounted state, is fixedly disposed in the screen device, and the screen roller is arranged rotatably with respect to this screen roller end piece.

In this way, fastening means, in order to receive the screen roller rotatably in the screen device, can be made more compact.

The screen roller end piece can thus butt in a more compact manner against the corresponding lateral side of the screen device. As a result, it is also possible to make the constriction in this screen roller end piece and the thickening of the screen butt more tightly against this lateral side. A screen guide for guiding this thickening can hence also be made more compact than in the prior art.

Also in screen devices having such a fixedly disposed screen roller end piece and a rotatably arranged screen roller, wherein the motor is arranged in the traditional manner and the thickening is thus not, in the rolled-up state of the screen, positioned at least partially closer to the screen roller axis than any point on that part of the motor that is fitted in the screen roller, which point is situated the furthest from this screen roller axis, parts of the screen device can in this way be made more compact.

The motor of a screen device according to an embodiment of this invention can more specifically comprise a motor body, which, according to a direction of rotation about the longitudinal direction of the screen roller, is fixedly fitted in the screen roller, and comprise a motor head, which is provided rotatably with respect to the motor body.

In a said embodiment having a screen roller end piece which is fixedly disposed, in order to arrange this screen roller end piece fixedly, this screen roller end piece can be fastened to such a motor head, fixedly according to the said direction of rotation.

A screen device having such a motor with motor body and motor head preferably further comprises a fastening head, which is fixedly fastened to the motor head, and a fastening body, which is fixedly disposed in the screen device and to which the fastening head is fastenable in order to receive the screen roller in the screen device. Such a fastening body can in this case, for example, form part of a screen box of the screen device, in which the screen roller is received.

The fastening head can, more specifically, be fastenable to the fastening body via a linear sliding movement, transversely to the longitudinal direction of the screen roller, in order to provide this such that it is easily fastenable.

In a said embodiment having a screen roller end piece, wherein this screen roller end piece is fixedly fastened to the screen roller, the fastening head can be fastened to the motor head, for example, with the aid of a shaft extending through the screen roller end piece. This fastening head and this shaft can in this case possibly be designed as an integral part of the motor.

In a said embodiment having a screen roller end piece which is fixedly disposed in the screen device, this screen roller end piece, at the end away from the screen roller, is preferably provided with this fastening head.

The screen roller of a screen device according to an embodiment of this invention will always be at least partially of hollow construction, with an access opening to this cavity at the said end, so that the motor can be received at least partially in this cavity. This screen roller can in this case advantageously be designed as a hollow tube.

The screen roller can, however, also further be shaped, this, for example, in order to be able to position the motor more easily in the screen roller and secure it at least partially in this screen roller.

More specifically, the screen roller can also, for example, be designed at the said end such that it tapers towards this end. If such a screen device is also provided with a screen roller end piece which is designed such that it tapers, on the side of the screen roller, towards the constriction, then the taper of the screen roller can advantageously smoothly connect to the taper of the screen roller end piece.

A particular embodiment of a screen device according to this invention further comprises an insert, which is fastened to the said end of the screen roller and in which the motor is partially fitted for the fastening of the motor in the screen roller. More specifically, this insert can for this purpose also partially be fitted in this end.

With the aid of such an insert, the screen roller can assume simple forms, whilst the insert can more specifically be shaped for the fastening of the motor in the screen roller.

More specifically, this insert can be provided, for example, with a locking rim, extending at least partially transversely to the longitudinal direction of the screen roller, for locking the motor in the screen roller. Analogously, the motor is then preferably provided with a corresponding locking rim, so that the motor can be locked in the screen roller by mutual engagement of these locking rims.

Preferably, this insert is designed such that it at least in part tapers away from the screen roller.

In embodiments having a screen roller end piece, this taper of the insert forms a smooth transition between the screen roller and the screen roller end piece, which, when the screen roller end piece is fixedly disposed, helps to ensure that this screen roller end piece would not slow down the screen during the roll-up and unrolling movement.

If such a screen device is provided with a screen roller end piece which is designed such that it tapers, on the side of the screen roller, towards the constriction, then the taper of the insert can advantageously smoothly connect to the taper of the screen roller end piece.

BRIEF DESCRIPTION OF THE DRAWINGS

This invention is now explained in greater detail on the basis of the hereinafter following detailed description of a preferential embodiment of a screen device according to this invention. The aim of this description is solely to provide illustrative examples and to indicate further advantages and particularities of the invention, and thus can by no means be interpreted as a limitation of the scope of the invention or of the patent rights claimed in the claims.

In this detailed description, reference is made by means of reference numerals to the accompanying drawings, wherein in FIG. 1 is depicted schematically in cross section a part of a screen roller adjacent to its end, with a screen which can be rolled up and unrolled thereon, an insert and a screen roller end piece of a screen device according to this invention.

DETAILED DESCRIPTION

The depicted screen device comprises a screen roller (1), on which a screen (2) can be rolled up and unrolled herefrom. For this purpose, the screen roller (1) is rotatable about a screen roller axis (A). The roll-up and unrolling movement of the screen (2) is driven with the aid of a motor (7), which is partially fitted in the screen roller (1) with the aid of an insert (3).

The screen roller (1) is designed as a hollow tube. In order to prevent the motor (7) from being able to penetrate further into the screen roller (1), the insert (3) is provided with a locking rim (11) and the motor (7) is provided with a corresponding locking rim (12). These locking rims (11, 12) extend substantially transversely to the longitudinal direction of the screen roller (1).

The motor (7) comprises a motor body (8), which is fixedly fitted in the screen roller (1) according to the direction of rotation of the screen roller (1) in the rolling-up and unrolling of the screen (2), and a motor head (9), which is provided rotatably with respect to the motor body (8).

To the motor head (9) is fastened a screen roller end piece (4), fixedly according to the direction of rotation of the screen roller (1). At its end, away from the screen roller (1), the screen roller end piece (4) is provided with a fastening head (10). With the aid of this fastening head (10), this screen roller end piece (4) can be fastened, via a linear sliding movement perpendicular to the longitudinal direction of the screen roller (1), fixedly in the screen device, this, for example, to an end piece of a screen box. Such fastenings with the aid of such a fastening head (10) are already known.

Typically, in the known devices however, the motor head (9), which is designed as a fastening head, is fastened directly to such an end piece. This motor head (9) can also be fastened to such an end piece with the aid of an intermediate piece. This now happens with the screen roller end piece (4) as the intermediate piece. During this sliding movement, this fastening head (10) can be mechanically coupled with this end piece. At the same time, an electrical coupling can also take place, wherein the motor (7) is connected up to a supply cable. For this purpose, the electrical wiring to the motor (7) should then also partially be installed in the screen roller end piece (4).

The screen (2) of the screen device is provided on its depicted lateral side with a thickening (6), which can be guided, for example with the aid of a screen guide, during the roll-up and unrolling movement of the screen (2). This thickening (6) can be designed, for example, as a half zip fastener. Adjacent to this thickening (6), the screen roller end piece (4) comprises a constriction (5), which, viewed according to the longitudinal direction of the screen roller (1), is disposed next to the motor (7).

This constriction (5) here has a smallest dimension ($d_e$), transversely to the longitudinal direction of the screen roller (1), which is smaller than the largest corresponding dimension ($D_m$) of the motor (7). The thickening (6) is hence, in the rolled-up state of the screen (2), partially positioned closer to the screen roller axis (A) than any point on that part of the motor (7) that is fitted in the screen roller (1), which point is situated furthest from this screen roller axis (A).

The shell surface of the screen roller end piece (4) is of smooth construction, so that this does not slow down the screen (2) during the roll-up and unrolling movement. For this purpose, the diameter ($D_e$) of the screen roller end piece (4) is, closest to the screen roller (1), also smaller than the diameter ($D_s$) of the screen roller (1). For this purpose, the insert (11) is at its end away from the screen roller (1), still designed such that it is conically tapered towards the screen roller end piece (4) in order to realize a smooth transition between the screen roller (1) and the screen roller end piece (4).

In order to still be able to adjust the end positions of the screen (2) despite this arrangement of the constriction (5) with respect to the motor (7), the motor (7) is designed as an electronic tube motor (7).

The invention claimed is:

1. A screen device comprising:

a screen roller, which is arranged rotatably about a screen roller axis;

a screen configured to reversibly transition between a first, rolled up state on the screen roller and a second, unrolled state on the screen roller, the screen comprising a thickening on at least one lateral side, wherein the thickening, in the first state of the screen, is positioned at least partially closer to the screen roller axis than any point on an outer circumference of the screen roller that is furthest from the screen roller axis; and an electric motor for driving the screen roller, wherein the motor is disposed at least partially inside the screen roller at an end of the screen roller that is positioned closest to the thickening, thereby defining portions of the motor inside the screen roller;

wherein the motor is fitted sufficiently inside the screen roller such that, in the first state of the screen, the thickening is positioned at least partially closer to the screen roller axis than at least one point on the portions of the motor inside the screen roller, wherein the screen device, at the end of the screen roller that is positioned closest to the thickening, comprises a screen roller end piece, the screen roller end piece comprising a constriction such that, when the screen is in the first state and in the second state, the thickening ends up adjacent to the constriction, wherein the screen roller end piece is fixedly disposed in the screen device, and wherein the screen roller is arranged rotatably relative to the screen roller end piece, wherein the motor comprises a motor body that is configured to rotate about a longitudinal direction of the screen roller and is fixedly fitted in the screen roller, and wherein the motor comprises a motor head that is configured to rotate with respect to the motor body, and wherein the screen roller end piece is fixedly fastened to the motor head according to the longitudinal direction of the screen roller.

2. The screen device according to claim 1, characterized in that the electric motor is an electric tube motor.

3. The screen device according to claim 1, characterized in that any external dimension of the screen roller end piece closest to the screen roller is smaller than an outside diameter of the screen roller when the screen roller end piece closest to the screen roller is viewed transversely to a longitudinal direction of the screen roller.

4. The screen device according to claim 1, characterized in that the screen roller end piece comprises a shell surface that does not impede movement of the screen during the reversible transition from the first state of the screen to the second state of the screen.

5. The screen device according to claim 1, characterized in that the screen roller end piece tapers towards the constriction on the lateral side of the screen roller.

6. The screen device according to claim 1, characterized in that the screen device comprises a fastening head that is fixedly fastened to the motor head, the motor head being a portion of the motor, the motor being disposed at least partially inside the screen roller, wherein the screen device comprises a fastening body that is fixedly disposed in the screen device, wherein, when the fastening body is fastened to the fastening head, the screen device is able to receive the screen roller with the screen thereon, wherein, when the fastening body is disconnected from the fastening head, the screen roller is removable from the screen device, wherein the screen roller together with the motor is configured to be connected to the fastening body by connecting the fastening body to the fastening head, and wherein the screen roller together with the motor is configured to be disconnected from the fastening body by disconnecting the fastening body from the fastening head.

7. The screen device according to claim 6, characterized in that the screen roller end piece comprises the fastening head at an end opposite to the screen roller.

8. The screen device according to claim 1, characterized in that the screen device comprises an insert that is fastened to the end of the screen roller that is positioned closest to the thickening and that is at least partially configured to fasten the motor in the screen roller.

9. The screen device according to claim 8, characterized in that the insert at least partially tapers away from the screen roller.

10. The screen device according to claim 5, wherein the screen device comprises an insert that is fastened to the end of the screen roller that is positioned closest to the thickening and that is at least partially configured to fasten the motor in the screen roller.

11. The screen device according to claim 1, characterized in that the constriction, when viewed in a longitudinal direction of the screen roller, has a dimension ($d_e$) transverse to the longitudinal direction of the screen roller that is smaller than a largest corresponding dimension ($D_m$) of the portions of the motor inside the screen roller.

12. The screen device according to claim 6, characterized in that the fastening body forms part of a screen box of the screen device.

13. The screen device according to claim 6, characterized in that the fastening head is fastenable to the fastening body via a linear sliding movement, the movement occurring transversely to the longitudinal direction of the screen roller.

14. The screen device according to claim 1, characterized in that the screen device comprises at least one screen guide for guiding the thickening during the reversible transition between the first, rolled up state and the second, unrolled state.

* * * * *